US007868865B2

(12) United States Patent
Shin et al.

(10) Patent No.: US 7,868,865 B2
(45) Date of Patent: Jan. 11, 2011

(54) ORGANIC ELECTROLUMINESCENCE DISPLAY AND METHOD OF OPERATING THE SAME

(75) Inventors: Dong-Yong Shin, Suwon-si (KR); Yoiiro Matsueda, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1406 days.

(21) Appl. No.: 11/289,543

(22) Filed: Nov. 30, 2005

(65) Prior Publication Data

US 2006/0114196 A1 Jun. 1, 2006

(30) Foreign Application Priority Data

Dec. 1, 2004 (KR) ..... 10-2004-0100011

(51) Int. Cl.
*G09G 3/36* (2006.01)

(52) U.S. Cl. ..... 345/92; 345/87; 345/90; 345/97; 345/100; 345/103

(58) Field of Classification Search ..... 345/76, 345/80, 87–90, 97–103, 204, 206, 690, 75.2; 349/37, 148, 141, 152; 313/498, 500, 506, 313/509; 359/296
See application file for complete search history.

(56) References Cited

U.S. PATENT DOCUMENTS 4,830,466 A * 5/1989 Matsuhashi et al. ..... 349/143
6,249,601 B1 6/2001 Kim et al.
6,366,026 B1 * 4/2002 Saito et al. ..... 315/169.3
6,437,767 B1 * 8/2002 Cairns et al. ..... 345/100
6,483,565 B1 * 11/2002 Hidehira et al. ..... 349/141
6,552,703 B1 * 4/2003 Ushigusa ..... 345/77
6,587,087 B1 * 7/2003 Ishizuka ..... 345/82
6,894,667 B1 * 5/2005 Lin ..... 345/87
7,176,876 B2 * 2/2007 Kabuto et al. ..... 345/100
2002/0149323 A1 * 10/2002 Ito ..... 315/169.3
2003/0071804 A1 * 4/2003 Yamazaki et al. ..... 345/204
2003/0128200 A1 * 7/2003 Yumoto ..... 345/211
2004/0070808 A1 * 4/2004 Nakanishi ..... 359/245
2004/0115989 A1 * 6/2004 Matsueda et al. ..... 439/577
2004/0189553 A1 * 9/2004 Kabuto et al. ..... 345/75.2
2005/0168490 A1 * 8/2005 Takahara ..... 345/690

(Continued)

FOREIGN PATENT DOCUMENTS

CN 1477613 2/2004

(Continued)

*Primary Examiner*—Prabodh M Dharia
(74) *Attorney, Agent, or Firm*—H.C. Park & Associates, PLC

(57) ABSTRACT

An organic electroluminescence display and a method of operating the organic electroluminescence display are disclosed. A pixel array unit, including a plurality of pixels, is divided into at least two pixel groups adjacent to each other. The first pixel group is selected by a first scan driving unit and the second pixel group is selected by a second scan driving unit. Scanning lines for selecting the first pixel group extend into the first pixel group and scanning lines for selecting the second pixel group extend into the second pixel group. Accordingly, each scanning line is reduced in length and thus impedance of the scanning line is decreased. The reduction of impedance prevents delay or distortion of scan signals.

17 Claims, 7 Drawing Sheets

U.S. PATENT DOCUMENTS

| | | | | |
|---|---|---|---|---|
| 2006/0114196 | A1* | 6/2006 | Shin et al. | 345/76 |
| 2007/0146251 | A1* | 6/2007 | Tsuge et al. | 345/76 |
| 2008/0084365 | A1* | 4/2008 | Takahara et al. | 345/76 |
| 2008/0246704 | A1* | 10/2008 | Kawase | 345/80 |

FOREIGN PATENT DOCUMENTS

| | | | |
|---|---|---|---|
| JP | 411237646 | A * | 8/1999 |
| JP | 2000-056707 | | 2/2000 |
| JP | 2003-150082 | | 5/2003 |
| JP | 2003-150104 | | 5/2003 |
| JP | 2003-150109 | | 5/2003 |
| JP | 2003-216100 | | 7/2003 |
| JP | 2004-004675 | | 1/2004 |
| JP | 2004-111194 | | 4/2004 |
| JP | 2004-111320 | | 4/2004 |
| WO | 01-06484 | | 1/2001 |

* cited by examiner

ORGANIC ELECTROLUMINESCENCE DISPLAY AND METHOD OF OPERATING THE SAME

CROSS REFERENCE TO RELATED PATENT APPLICATION

This application claims priority to and the benefit of Korean Patent Application No. 10-2004-0100011, filed on Dec. 1, 2004, which is hereby incorporated by reference for all purposes as if fully set forth herein.

BACKGROUND OF THE INVENTION

1. Field of the Invention

The present invention relates to an organic electroluminescence display having two scan driving units for reducing the rising time or falling time of a scan signal and a method of operating the organic electroluminescence display.

2. Discussion of the Background

Organic electroluminescence displays are flat self-emitting displays which emit light by applying an electric field to fluorescent substances coated on a glass substrate or a transparent organic layer. Electroluminescence is a phenomenon whereby fluorescent substances supplied with an electric field emit light.

FIG. 1 shows an energy level diagram for an organic electroluminescence element.

Referring to FIG. 1, an organic electroluminescence element has a structure that an organic thin layer 100 is disposed between an anode, which is a transparent electrode such as ITO (Indium Tin Oxide), and a cathode made of metal having a low work function.

When a forward voltage is applied to the organic electroluminescence element, holes are injected from the anode and electrons are injected from the cathode. The injected holes and electrons couple together to form excitons. The excitons carry out radiative recombination by emitting light during recombination.

The organic electroluminescence element includes a hole injecting layer (HIL) 101, a hole transporting layer (HTL) 103, a light emitting layer (EML) 105, a hole blocking layer (HBL) 107, an electron transporting layer (ETL) 109, and an electron injecting layer (EIL) 111. The organic electroluminescence element is formed in a multi-layered structure because the holes and electrons vary greatly in mobility through an organic material. Since the mobility of electrons is much greater than the mobility of holes, imbalance in density between the holes and the electrons in the light emitting layer 105 occurs. Accordingly, the hole transporting layer 103 and the electron transporting layer 109 are used to effectively transport the holes and the electrons to the light emitting layer 105.

A method of lowering an energy barrier for injecting holes by additively inserting the hole injecting layer 101, made of conductive polymer or copper (Cu) alloy, between the anode and the hole transporting layer 103 can be also used. In addition, by adding a thin hole-blocking layer 107 made of, for example, Lithium Fluoride (LiF) between the cathode and the electron transporting layer 109, the energy barrier for injecting electrons can be reduced to enhance the light emission efficiency, thereby reducing the driving voltage.

The organic electroluminescence display is classified into a passive matrix type and an active matrix type, depending upon the driving methods.

The passive matrix electroluminescence display is a device where anodes and cathodes extend perpendicularly to each other and are disposed to intersect each other in a matrix shape. Pixels are formed in the intersections between the anodes and the cathodes.

Conversely, the active matrix electroluminescence display is a device where a thin film transistor is formed in each pixel and each pixel is individually controlled by using the thin film transistor (TFT).

The emission times for active matrix type and passive matrix type organic electroluminescence displays vary greatly. The passive matrix electroluminescence display allows an organic light-emitting layer to instantaneously emit light with high brightness, but the active matrix electroluminescence display allows the organic light-emitting layer to continuously emit light with low brightness.

With the passive matrix type, the instantaneous emission brightness is increased in order to increase resolution. In addition, since it emits light with high brightness, the organic electroluminescence display easily deteriorates. On the contrary, in case of the active matrix type, since the pixels are driven using the TFTs and continuously emit light for one frame, they can be driven with low current. Therefore, the active matrix type has parasitic capacitance and power consumption lower than those of the passive matrix type.

However, the active matrix type has a defect: brightness is not uniform across the panel. The active matrix type mainly employs a Low Temperature Poly Silicon (LTPS) TFT as an active element. The LTPS TFT is comprised of crystallized amorphous silicon, which is formed in a low temperature by using a laser. However, the characteristics of each thin film transistors can vary due to variations in crystallization. Specifically, threshold voltages of the transistors are not uniform pixel by pixel. Therefore, individual pixels can exhibit different brightness levels with the same image signal, which causes non-uniform brightness difference across the panel The problem of non-uniform brightness may be solved by compensating for the characteristics of driving transistors. Compensation for the characteristics of the driving transistors is classified into two kinds according to driving type: voltage programming method and current programming method.

The voltage programming method is a technique for storing the threshold voltages of the driving transistors in capacitors and compensating for the stored threshold voltages of the driving transistors.

In the current programming method, an image signal is supplied in current and a source-gate voltage of a driving transistor corresponding to the image signal current is stored in a capacitor. Then, the driving transistor is connected to a voltage source and the same current as the image signal current is allowed to flow in the driving transistor. Essentially, the value of current applied to the organic light-emitting layer is a value of the image signal current, regardless of the characteristic difference between the driving transistors. Therefore, the non-uniform brightness is corrected.

Another manner of compensating for brightness, by using a driving circuit, is not a technique for compensating for the characteristics of the driving transistors but a technique for allowing the driving transistors to work in a region having small variation.

FIG. 2A shows a block diagram of a conventional organic electroluminescence display.

Referring to FIG. 2A, the conventional organic electroluminescence display has a scan driving unit 201, a first data driving unit 203, a second data driving unit 205, and a pixel array unit 207 in which pixels are arranged in a matrix shape.

The scan driving unit 201 supplies scan signals to the pixel array unit 207 through scanning lines 1-m (SCAN[1]-SCAN

[m]) and supplies control signals to the pixel array unit 207 through emission control lines 1-m (EMI[1]-EMI[m]).

The first data driving unit 203 and the second data driving unit 205 supply data signals to pixels selected by the scan signals from the scan driving unit 201. The data signals are programmed in the pixels selected in a current or voltage type. When the programming operation is finished, the scan driving unit 201 supplies the emission control signals to the selected pixels, thereby allowing the organic electroluminescence elements to emit light.

The pixel array unit 207 includes a plurality of pixels arranged in a matrix shape. Each pixel has an organic electroluminescence element for emitting light and a driving circuit for controlling the emission operation of the pixel. Each pixel is connected to a data line for transmitting a data signal, a scanning line for supplying a scan signal, an emission control line for supplying an emission control signal, and an ELVdd line (not shown) for supplying current necessary for emission of the organic electroluminescence element.

FIG. 2B shows a timing diagram of a conventional organic electroluminescence display.

Referring to FIG. 2A and FIG. 2B, when the scan signal SCAN[1] of the scan driving unit 201 changes from a high level to a low level signal, the pixels of the first row are selected. When the selected pixels are supplied with the data signals from the data driving unit 203 and 205, the selected pixels are programmed. The programming operation of the selected pixels can be carried out in a voltage or current type.

When the programming operation of the pixels of the first row is completed, the emission control signal EMI[1] is supplied to the pixels of the first row from the scan driving unit 201 and the pixels of the first row start emitting light.

The data programming of each subsequent row is carried out sequentially and the programmed pixels sequentially emit light. When the data programming and the emission of the pixels of row [m] are complete, the display of the image signals for one frame is complete.

In the conventional organic electroluminescence display, the scan driving unit is disposed at the left or right side of the pixel array unit and drives a plurality of pixels disposed in a row. When the pixels of the first row are selected, the pixels disposed apart from the scan driving unit 201 are supplied with the delayed scan signals. Thus, when the pixels at the end of the first row are selected, the pixels at the start of the second row are also selected. Data signals must be input simultaneously to opposing ends of the first row and the second row due to the delay of signals.

Scan signals in which the delay time is reflected may be applied, but this solution is not desirable because the delay time depends upon the line resistance of the scanning lines and the capacitance of the pixels. However, since the constants that affect the time delay are slightly different for each pixel, time delay cannot be determined with certainty.

SUMMARY OF THE INVENTION

This invention provides an organic electroluminescence display that can select pixels disposed in one row with two scan signals.

The present invention also provides a method of operating an organic electroluminescence display that can select pixels disposed in one row with two scan signals.

Additional features of the invention will be set forth in the description which follows, and in part will be apparent from the description, or may be learned by practice of the invention.

The present invention discloses an organic electroluminescence display comprising a pixel array unit having a first pixel group and a second pixel group, where each pixel group has a plurality of pixels, a first scan driving unit for applying a first scan signal to the first pixel group of the pixel array unit through a first scanning line, a second scan driving unit for applying a second scan signal to the second pixel group of the pixel array unit through a second scanning line, and a data driving unit for applying a data signal to the pixels of the pixel array unit selected by the first scan signal or the second pixel signal.

The present invention also discloses an organic electroluminescence display comprising a pixel for emitting light, a power source, a data line for transmitting a data signal to the pixel, an emission line for transmitting an emission signal to the pixel, and a scanning line for transmitting a scan signal to the pixel. Further, the scanning line extends across approximately one-half of the width of the organic electroluminescence display.

The present invention also discloses a method of emitting light from an organic electroluminescence display, where the method comprises selecting a first row of a first pixel group through a first scanning line, selecting a first row of a second pixel group through a second scanning line, applying a data signal to a first pixel in the first row of the first pixel group or the Xs first row of the second pixel group, and emitting light from the first pixel by applying an emission control signal to the first pixel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
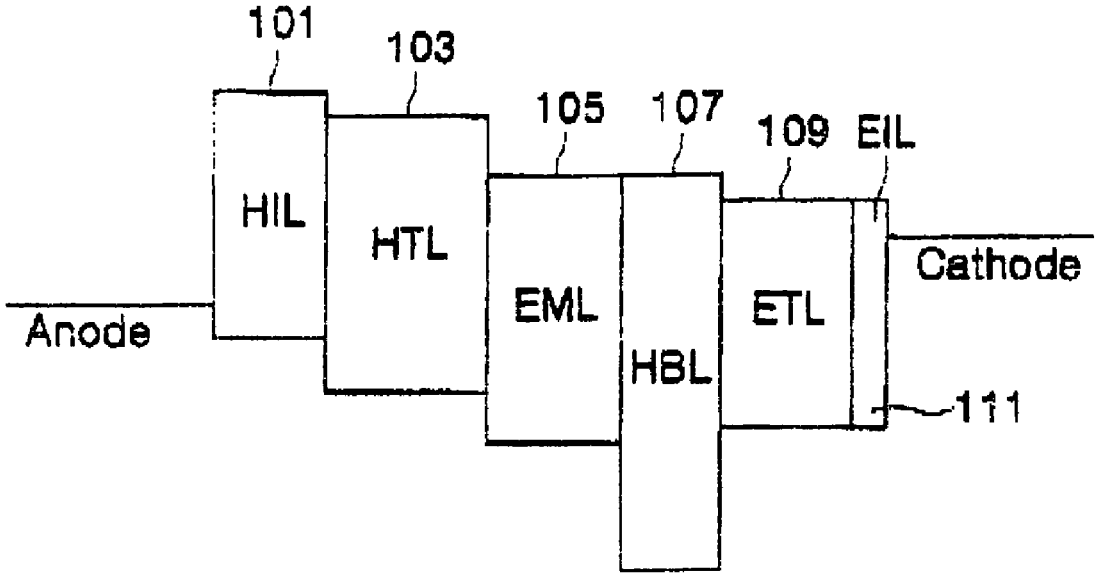
FIG. 1 (PRIOR ART)
FIG. 1 shows an energy level diagram of an organic electroluminescence element.
Figure 2A:
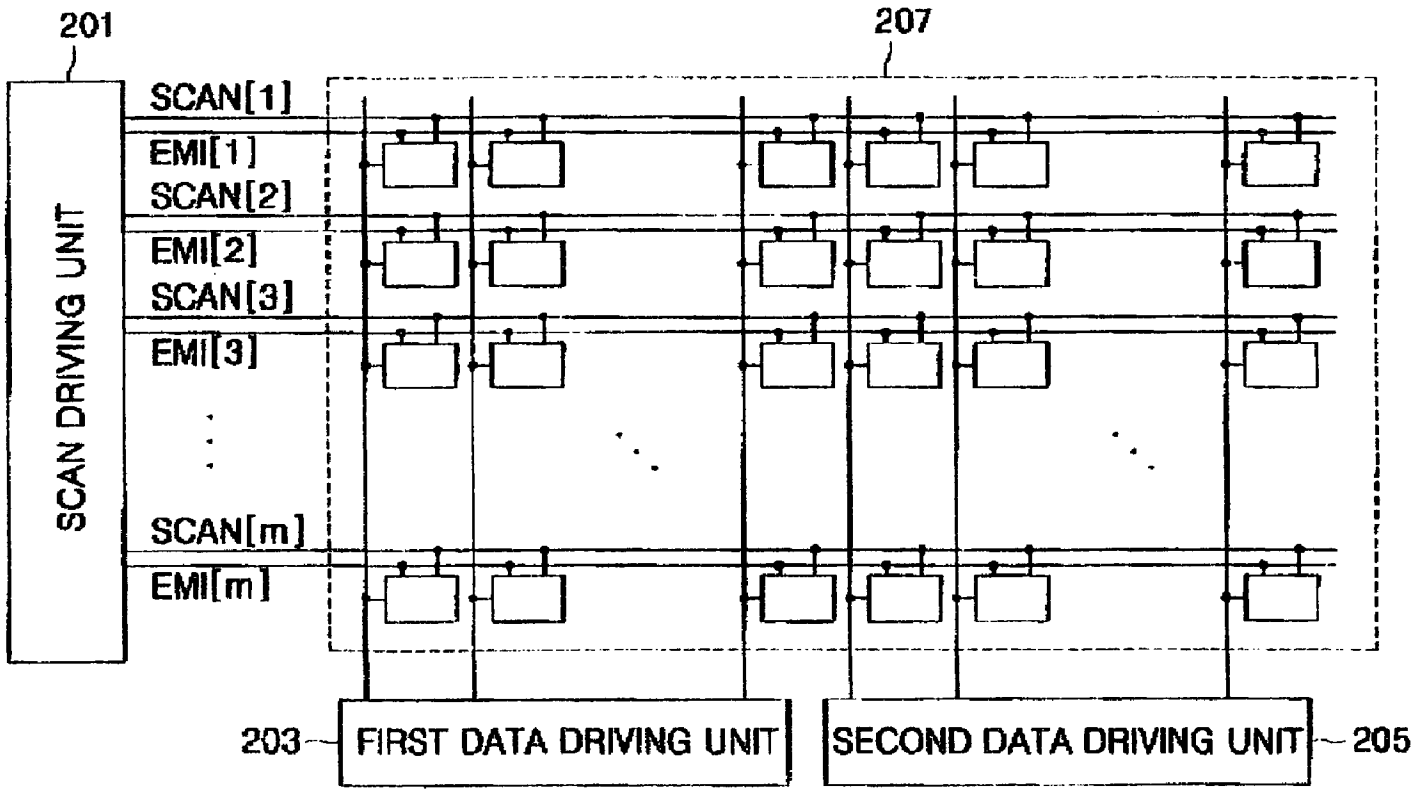
FIG. 2A (PRIOR ART)
FIG. 2A shows a block diagram of a conventional organic electroluminescence display.
Figure 2B:
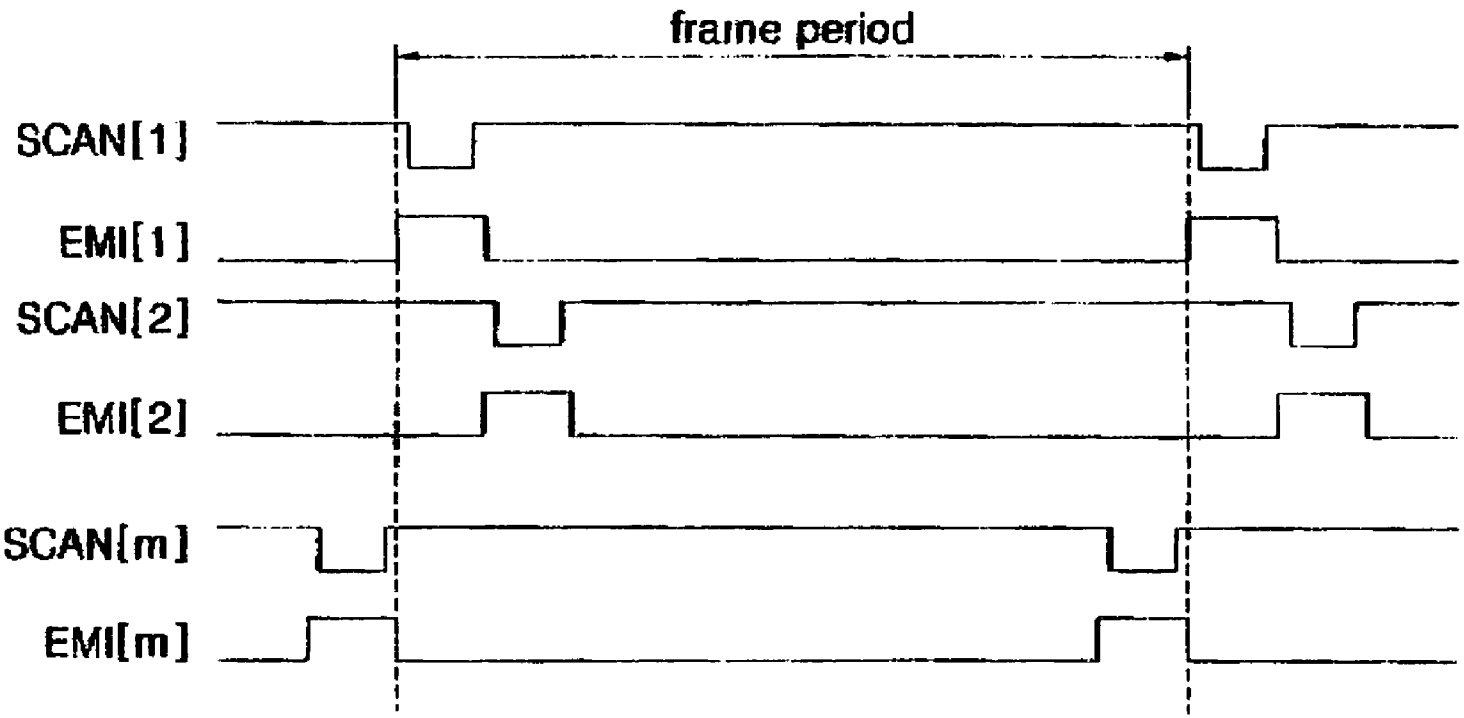
FIG. 2B (PRIOR ART)
FIG. 2B shows a timing diagram of a conventional organic electroluminescence display.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

Figure 3:
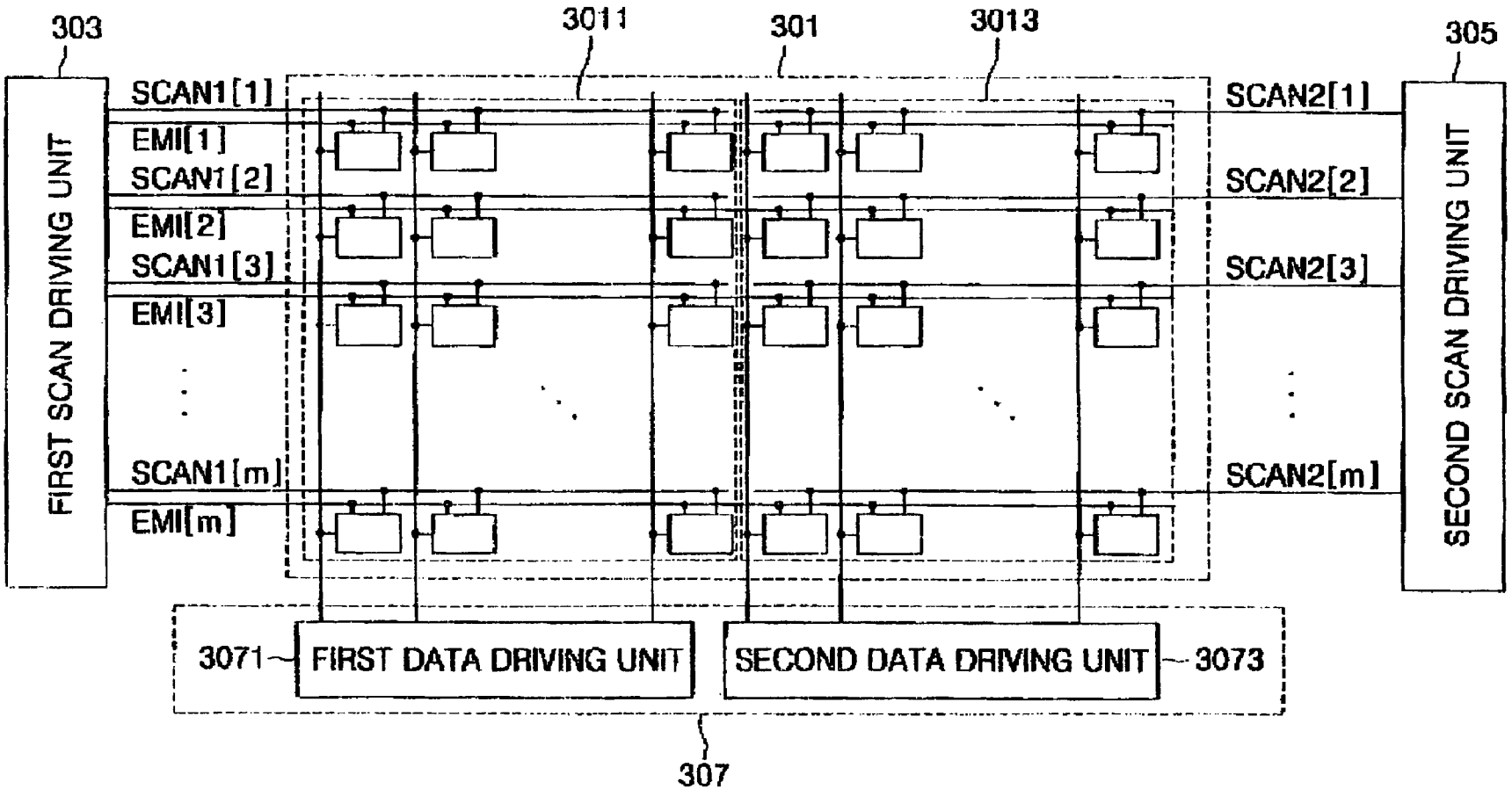
FIG. 3 shows a block diagram illustrating an organic electroluminescence display according to an exemplary embodiment of the present invention.

FIG. 3 shows a block diagram illustrating an organic electroluminescence display according to an exemplary embodiment of the present invention.

Referring to FIG. 3, the organic electroluminescence display according to the present embodiment includes a pixel array unit 301 with a plurality of pixels, a first scan driving unit 303 generating a first scan signal, a second scan driving unit 305 generating a second scan signal, and a data driving unit 307 supplying data signals to the pixels selected by the first scan signal or the second scan signal.

The pixel array unit 301 is divided into at least two groups. The pixel array unit 301 includes a first pixel group 3011 that is selected by the first scan signals SCAN1[1, 2, . . . , m] and a second pixel group 3013 that is selected by the second scan signals SCAN2[1, 2, . . . , m].

The first scan driving unit 303 supplies the first pixel group 3011 with the first scan signals SCAN1[1, 2, . . . , m] through a plurality of first scanning lines. The first scan driving unit 303 can supply the first pixel group 3011 and the second pixel group 3013 with the emission control signals EMI[1, 2, . . . , m] through a plurality of emission control lines.

The second scan driving unit 305 supplies the second pixel group 3013 with the second scan signals SCAN2[1, 2, . . . , m] through a plurality of second scanning lines. In addition, the second scan driving unit 305 may supply the first pixel group 3011 and the second pixel group 3013 with the emission control signals through a plurality of emission control lines.

The data driving unit 307 supplies data signals to the specific pixels selected by the first scan signals SCAN1[1, 2, . . . , m] and the second scan signals SCAN2[1, 2, . . . , m]. Although the data driving unit 307 includes a first data driving unit 3071 and the second driving unit 3073 as shown in the present embodiment, the number of data driving units may be changed in other embodiments of the present invention. However, for the purpose of describing the present embodiment, two data driving units are provided. The first data driving unit 3071 supplies the data signals to the pixels selected in the first pixel group 3011, and the second data driving unit 3073 supplies the data signals to the pixels selected in the second pixel group 3013.

Figure 4:
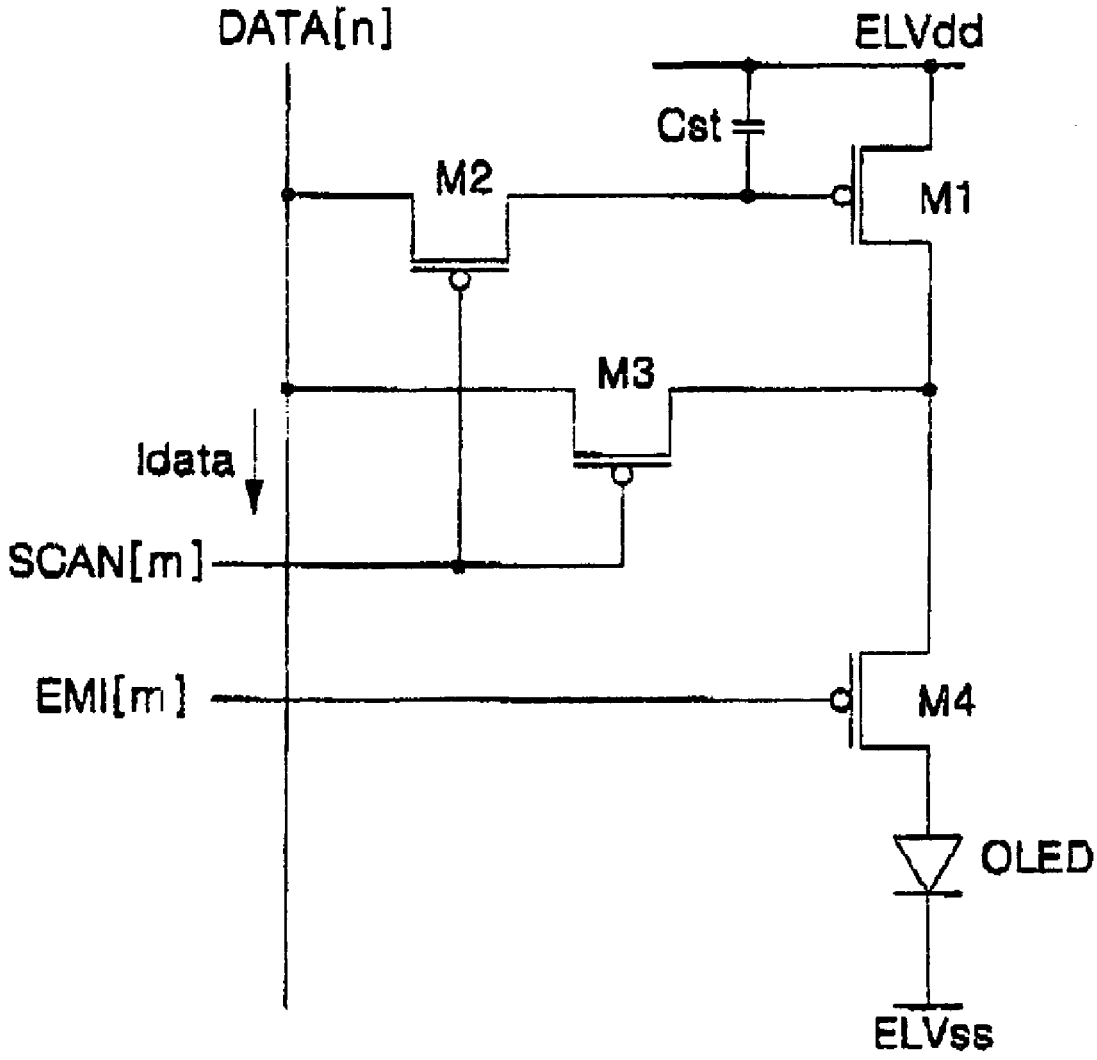
FIG. 4 shows a circuit diagram illustrating a current-programming type pixel driving circuit according to an exemplary embodiment of the present invention.

FIG. 4 shows a circuit diagram for a current-programming pixel driving circuit according to an exemplary embodiment of the present invention.

Referring to FIG. 4, the current-programming pixel driving circuit includes four transistors M1, M2, M3, and M4, a program capacitor Cst storing data current in the form of voltage, and an organic electroluminescence element diode (OLED) for emitting light.

The transistor M1 is a driving transistor that supplies the transistor M4 with the same current as the data current Idata sinking through a data line DATA[n]. In order to generate the same current as the data current Idata, the gate of the driving transistor M1 is connected to one terminal of the program capacitor Cst and the transistor M2. The driving transistor M1 is connected to high voltage source ELVdd and is also connected to the transistors M3 and M4.

The transistor M2 is a switching transistor that turns on in response to the scan signal SCAN[m] and forms a voltage path between the data line and the program capacitor Cst. In addition, the switching transistor M2 applies a bias voltage to the gate of the driving transistor M1 to form a voltage difference between the gate and source (Vgs) of the driving transistor M1 corresponding to the data current.

The transistor M3 turns on in response to the scan signal SCAN[m] and supplies the current from the driving transistor M1 to the data line DATA[n] at the time of programming with data current.

The transistor M4 is an emission control transistor that turns on in response to an emission control signal EMI[m] and that supplies the current from the driving transistor to the OLED.

The current-programming pixel driving circuit stores the voltage Vgs corresponding to the data current Idata in the program capacitor Cst and supplies the data current Idata to the OLED by turning on the emission control transistor M3.

First, when the emission control signal EMI[m] is changed from a low level to a high level signal, the emission control transistor M4 is turned off. Once the emission control transistor M4 is turned off, the scan signal SCAN[m] changes to a low level. The data programming operation for the pixel selected by the low-level scan signal SCAN[m] then begins.

The transistors M2 and M3 are turned on by the low-level scan signal SCAN[m]. Where the transistors M2 and M3 are turned on, the data current Idata sinks through the data line DATA[n], thereby forming a current path between ELVdd, the driving transistor M1, and the transistor M3. When the data current Idata sinks, the switching transistor M2 works in the triode region. Since no substantial DC current flows through M2, only the bias voltage is supplied to the gate of the driving transistor M1.

In order to supply Idata from ELVdd to the data line DATA [n], the driving transistor M1 works in the saturation region. When the driving transistor M1 works in the saturation region, the current data flowing through the driving transistor M1 is obtained by Equation 1.

$$Idata=K(Vgs-Vth)^2 \quad \text{[Equation 1]}$$

In Equation 1, K denotes a proportional constant, Vgs denotes a voltage difference between the gate and the source of the driving transistor M1, and Vth denotes a threshold voltage of the driving transistor M1.

While the data current Idata flows through the driving transistor M1 and the transistor M3, Vgs of the driving transistor M1 corresponding to the data current Idata is stored in the program capacitor Cst. Vgs is equal to the voltage difference between ELVdd and the bias voltage applied to the gate terminal of driving transistor M1.

Subsequently, when the scan signal SCAN[m] is changed from a low-level signal to a high-level signal, the transistors M2 and M3 are turned off and the program capacitor Cst is charged with the voltage Vgs.

Subsequently, when the emission control signal EMI[m] is changed from a high-level signal to a low-level signal, the emission control transistor M4 is turned on. By turning on the emission control transistor M4, the driving transistor M1 operates in the saturation region and the current Idata corresponding to the voltage Vgs stored in the program capacitor Cst is supplied to the transistor M4. The data current Idata is supplied to the OLED through the emission control transistor M4 and the OLED emits light with the brightness corresponding to the data current Idata.

Figure 5:
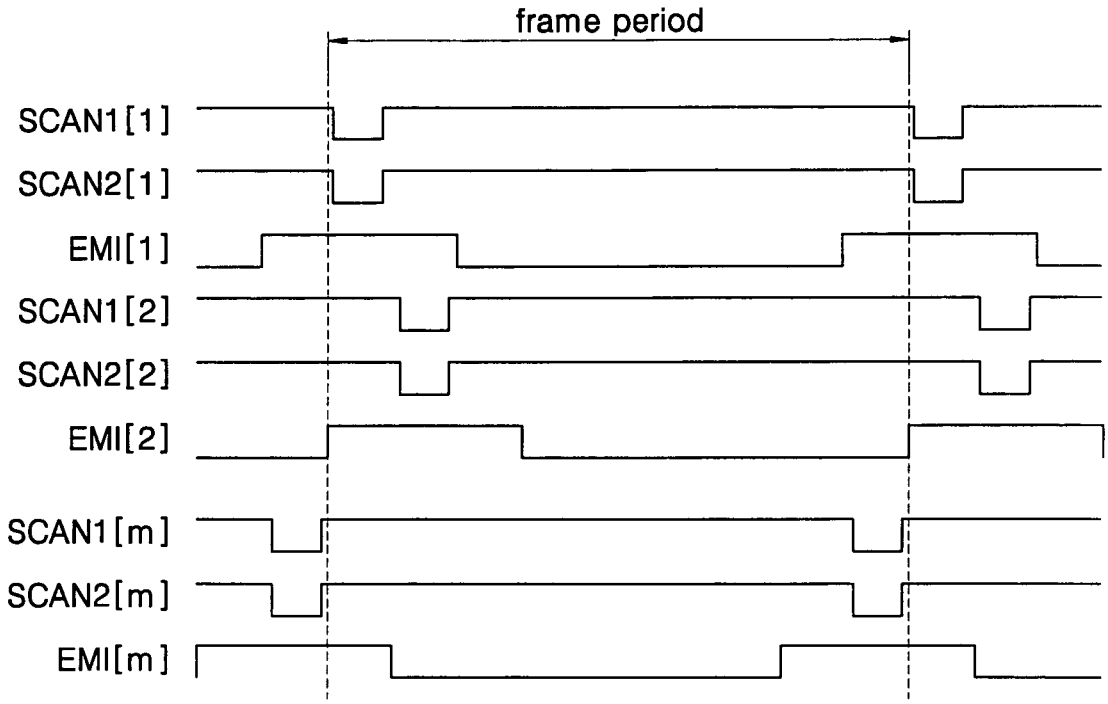
FIG. 5 shows a timing diagram illustrating operations of the organic electroluminescence display shown in FIG. 3.

FIG. 5 shows a timing diagram illustrating operations of the organic electroluminescence display shown in FIG. 3 according to the exemplary embodiment of the present invention.

The operation of the organic electroluminescence display shown in FIG. 3 will be described with reference to FIG. 5.

First, pixels are selected by the Scan Driving Units. First scan signals SCAN1[1, 2, . . . , m] are applied through the scanning lines in the first pixel group 3011 and scan signals SCAN2[1, 2, . . . , m] are applied through the scanning lines in the second pixel group 3013 for a frame period.

After the first scan driving unit 303 applies the first scan signal SCAN1[1] to the pixels disposed in the first row of the first pixel group 3011 through the first scanning line, the pixels disposed in the first row of the first pixel group 3011 are selected and the programming operation by the first data driving unit 3071 is carried out. The second scan signal SCAN2[1] is applied through the second scanning line at the same time as application of the first scan signal SCAN1[1]. In response to application of the second scan signal SCAN2[1] through the second scanning line, the pixels disposed in the first row of the second pixel group 3013 are selected and the programming operation by the second data driving unit 3073 is carried out.

When the programming operation of the data current is applied, the voltages Vgs of the driving transistors of the pixels disposed in the first row of the first pixel group 3011 and in the first row of the second pixel group 3013 are stored in the program capacitors.

Subsequently, when the first scan signal SCAN1[1] and the second scan signal SCAN2[1] are changed to a high level, the program capacitors of the programmed pixels hold the voltages Vgs of the driving transistors of the corresponding pixels.

When the first emission control signal EMI[1] changed from a high-level signal to a low-level signal, the emission control transistors of the pixels disposed in the first rows of the first pixel group 3011 and the second pixel group 3013 are turned on. Therefore, the OLEDs in the selected pixels in the first row of the first pixel group 3011 and the second pixel group 3013 emit light with predetermined brightness.

After the programming operation of the data current to the pixels in the first pixel group 3011 and the second pixel group 3013 is completed, the programming operations of the data current to the pixels disposed in the second rows of the first pixel group 3011 and the second pixel group 3013 are performed. After the programming operation of the data current to the second row of pixels in the first pixel group 3011 and the second pixel group 3013 is complete, programming operation of the data current to subsequent rows is sequentially performed through row m for a frame period.

In the present described embodiment, the sequential programming operation of the data current to the respective rows employs a sequential scanning technique. However, the programming operation of the data current according to the present invention may employ an interlaced scanning technique.

In an interlaced scanning technique, pixels disposed in the odd rows are sequentially selected. The pixels in the first row of the first pixel group 3011 are selected using the first scan driving unit 303, and pixels in the first row of the second pixel group 3013 are selected using the second scan driving unit 305. The next selected row is the third row, and the next selected row is the fifth row. Such selection continues sequentially throughout the panel. Thus, the selection of the pixels disposed in the odd rows is performed for the first half period of the data frame. After the selection of the pixels disposed in the last odd row is finished, the selection of the pixels disposed in the even rows is sequentially performed for the second half period of the data frame.

Figure 6:
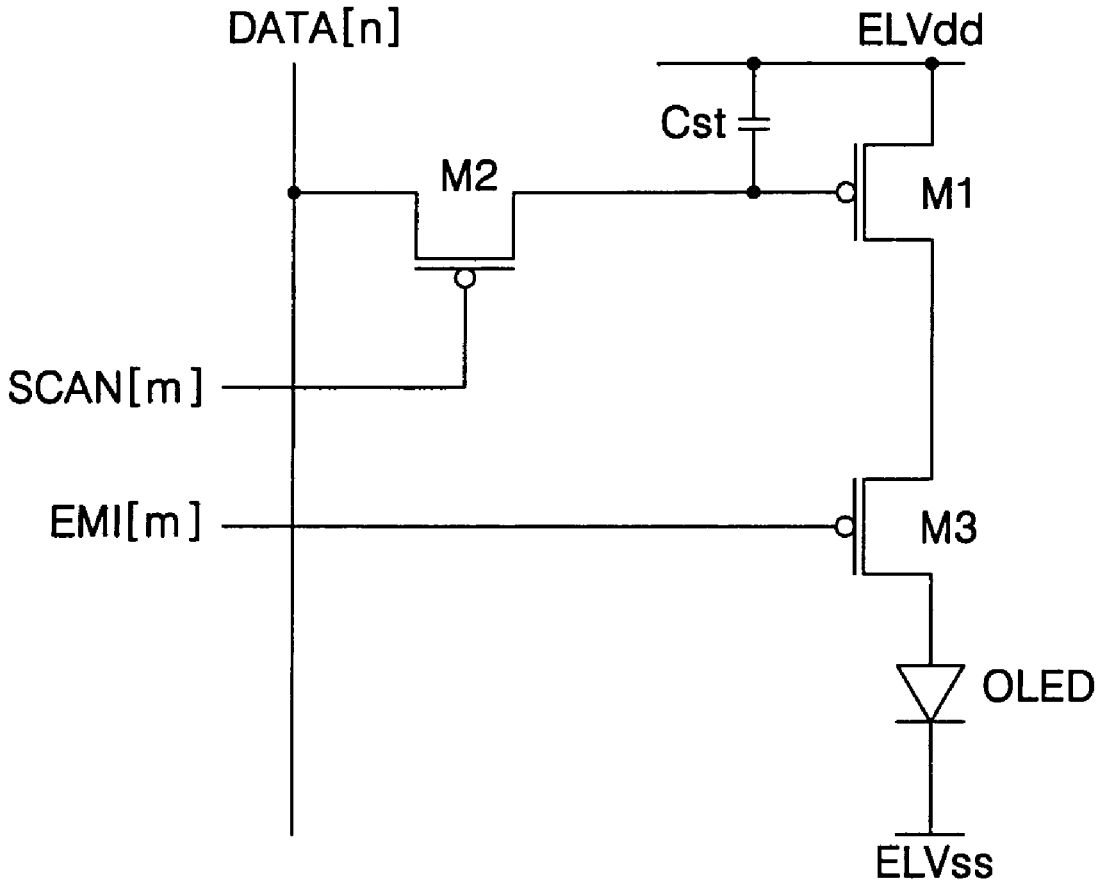
FIG. 6 shows a circuit diagram illustrating a voltage-programming type pixel driving circuit according to an exemplary embodiment of the present invention.

FIG. 6 shows a circuit diagram illustrating a voltage-programming pixel driving circuit according to an exemplary embodiment of the present invention.

Referring to FIG. 6, the voltage-programming pixel driving circuit according to the present embodiment includes a plurality of transistors M1, M2, and M3, a program capacitor Cst, and an OLED.

The transistor M1 is a driving transistor that supplies current to the OLED in accordance with the data voltage stored in the program capacitor Cst. The gate of the driving transistor M1 is connected to one terminal of the program capacitor Cst and the transistor M2.

The transistor M2 is a switching transistor that is turned on in response to the scan signal SCAN[m] and that forms a path through which the data voltage Vdata is supplied to the program capacitor Cst and the gate of the driving transistor M1. The switching transistor M2 is connected between a data line and the driving transistor M1.

The transistor M3 is an emission control transistor that is turned on in response to the emission control signal EMI[m] and that supplies the current from the driving transistor M1 to the OLED for light-emitting operation. The emission control transistor M3 is connected between the driving transistor M1 and the OLED.

The OLED is connected to the emission control transistor M3 and the cathode electrode ELVss. The brightness of the OLED is proportional to the amount of current flowing therein. Therefore, at the time of emission of the OLED, the brightness is proportional to the amount of current supplied from the driving transistor M1.

To begin the cycle, the emission control signal EMI[m] changes from a low-level signal to a high-level signal, and the emission control transistor M3 is turned off. Simultaneously, the scan signal SCAN[m] changes to a low-level signal, which turns on transistor M2.

The applied data voltage Vdata is applied through the turned-on transistor M2. By turning on the switching transistor M2, a voltage path is formed between the data line DATA [n] and the driving transistor M1, and the data voltage Vdata is applied to the gate of the driving transistor M1, thereby starting the programming operation of the data voltage. However, since current does not flow in the program capacitor Cst and the gate of the driving transistor M1, the switching transistor M2 works in the triode region and the voltage difference between the source and the drain is substantially 0V.

Thus, data voltage Vdata is applied to the gate of the driving transistor M1 and one terminal of the program capacitor Cst. ELVdd is applied to the second terminal of the capacitor Cst, which is charged with voltage difference ELVdd-Vdata. Subsequently, when the scan signal SCAN[m] is changed to a high-level signal, switching transistor M2 turns off, and the gate of the driving transistor M1 holds the data voltage Vdata.

When the emission control signal EMI[m] changes from a high-level signal to a low-level signal, the emission control transistor M3 is turned on. When the emission control transistor M3 turns on, the driving transistor M1 supplies the OLED with the current Idata corresponding to Vdata.

The current Idata is determined by Equation 2.

$$Idata=K(Vgs-Vth)^2=K(ELVdd-Vdata-Vth)^2$$

In Equation 2, K denotes a proportional constant and Vth denotes a threshold voltage of the driving transistor M1. From Equation 2, current Idata is inversely proportional to is the data voltage Vdata. Specifically, as Vdata decreases, Idata increases.

When the voltage-programming pixel driving circuit from FIG. 6 is applied to the organic electroluminescence display shown in FIG. 3, the operation of the organic electroluminescence display is as shown in the timing diagram of FIG. 5.

That is, the first pixel group 3011 and the second pixel group 3013 are independently selected and data can be programmed in two pixel groups simultaneously. The first pixel group 3011 is selected and programmed by the first scan driving unit 303 and the second pixel group 3013 is selected and programmed by the second scan driving unit 305.

Therefore, the length of the scanning lines is reduced to half the length of a scanning line in a conventional display, and because of the reduction in length of the scanning line, the line impedance of one scanning line is reduced compared with the case where the pixel array unit is selected using only one scan driving unit. As a result of the reduction of line impedence, the delay of the scan signals supplied through the scanning lines is also reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic electroluminescence display, comprising:

a pixel array unit disposed in a first area and having a first pixel group and a second pixel group, each pixel group including a plurality of pixels;

a first scan driving unit to apply a first scan signal to the first pixel group of the pixel array unit through a first scanning line;

a second scan driving unit to apply a second scan signal to the second pixel group of the pixel array unit through a second scanning line; and a data driving unit to apply a data signal to the pixels of the pixel array unit selected by the first scan signal or the second scan signal, wherein the first scan driving unit, the second scan driving unit, and the data driving unit are all disposed outside the first area, wherein the first scan signal and the second scan signal begin and end at the same time.

2. The organic electroluminescence display of claim 1, wherein the first scan driving unit supplies an emission control signal to the pixel array unit.

3. The organic electroluminescence display of claim 1, wherein the application of the first scan signal is simultaneous with the application of the second scan signal.

4. The organic electroluminescence display of claim 1, wherein the data driving unit comprises:

a first data driving unit to apply a data signal to the first pixel group; and a second data driving unit to apply a data signal to the second pixel group.

5. The organic electroluminescence display of claim 1, wherein the first pixel group comprises one-half of the pixels disposed on the pixel array unit.

6. The organic electroluminescence display of claim 1, wherein the second pixel group is located opposite the first pixel group about the center line of the pixel array unit.

7. The organic electroluminescence display of claim 6, wherein the center line is disposed vertically on the pixel array unit.

8. The organic electroluminescence display of claim 1, wherein the pixels in the pixel array unit comprise current-programming type circuits.

9. The organic electroluminescence display of claim 1, wherein the pixels in the pixel array unit comprise voltage-programming type circuits.

10. A method of emitting light from an organic electroluminescence display, comprising:

selecting a first row of a first pixel group by applying a first scan signal to a first scanning line;

selecting a first row of a second pixel group by applying a second scan signal to a second scanning line linearly arranged with, and spaced apart from, the first scanning line;

applying a data signal to a first pixel in the first row of the first pixel group or the first row of the second pixel group;

emitting light from the first pixel by applying an emission control signal to the first pixel, wherein the first scan signal and the second scan signal begin and end at the same time.

11. The method of claim 10, wherein the selecting a first row of a first pixel group further comprises:

turning off the emission control signal to all pixels in the first row of the first pixel group and all pixels in the first row of the second pixel group.

12. The method of claim 10, wherein the selecting a first row of a second pixel group further comprises:

turning off the emission control signal to all pixels in the first row of the first pixel group and all pixels in the first row of the second pixel group.

13. The method of claim 10, further comprising:

selecting a second row of the first pixel group through a third scanning line;

selecting a second row of the second pixel group through a fourth scanning line;

applying a data signal to a second pixel in the second row of the first pixel group or the second row of the second pixel group;

emitting light from the second pixel by applying an emission control signal to the second pixel.

14. The method of claim 13, wherein the first scanning line and the third scanning line are immediately adjacent scanning lines.

15. The method of claim 13, wherein the first scanning line and the third scanning line are not immediately adjacent scanning lines.

16. The method of claim 10, wherein the data signal comprises a voltage signal.

17. The method of claim 10, wherein the data signal comprises a current signal.

* * * * *